US006693534B2

(12) United States Patent
Costa et al.

(10) Patent No.: US 6,693,534 B2
(45) Date of Patent: Feb. 17, 2004

(54) EMERGENCY ALARM SYSTEM USING PULL-STATION WITH CAMERA

(75) Inventors: Hilario S. Costa, Sarasota, FL (US); Robert W. Right, Holmes Beach, FL (US); Jeffrey Burns, Bradenton, FL (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/961,103

(22) Filed: Sep. 24, 2001

(65) Prior Publication Data

US 2003/0058109 A1 Mar. 27, 2003

(51) Int. Cl.[7] ..... G08B 1/00

(52) U.S. Cl. ..... 340/531; 340/3.3; 340/3.31; 340/3.32; 340/287; 340/306; 340/506; 340/3.1

(58) Field of Search ..... 340/506, 525, 340/533, 539, 569, 686.1, 693.5, 693.6, 3.3, 3.31, 3.32, 286.02, 286.05, 286.06, 287, 304, 306

(56) References Cited

U.S. PATENT DOCUMENTS 5,546,072 A * 8/1996 Creuseremee et al. ..... 340/574
6,002,326 A * 12/1999 Turner ..... 340/426
6,052,052 A * 4/2000 Delmonaco ..... 340/539
6,529,230 B1 * 3/2003 Chong ..... 348/14.01

* cited by examiner

*Primary Examiner*—Daryl Pope
(74) *Attorney, Agent, or Firm*—Baker & Hostetler LLP

(57) ABSTRACT

An emergency alarm system is provided having a manually operated pull-station that activates the system. The emergency alarm system has a camera that provides image data of the area surrounding the pull-station. The emergency alarm system also has a control panel having an image memory that is operable to provide storage for the image data from the camera.

7 Claims, 4 Drawing Sheets

EMERGENCY ALARM SYSTEM USING PULL-STATION WITH CAMERA

FIELD OF THE INVENTION

The present invention relates generally to an emergency alarm system that is activated by manually operated alarm pull-stations. More particularly, the present invention relates to a fire alarm system that includes a device that produces an image of the person who actuated the fire alarm pull-station.

BACKGROUND OF THE INVENTION

Emergency alarm systems have been in existence for many years. These alarm systems include evacuation, tornado and fire alarm systems for commercial, industrial, municipal buildings and the like. Often, these systems include a combination of manually operated pull-stations and automatic sensor devices that are placed throughout the building and connected to a wiring system that communicates the activation of the automated sensors and pull-stations to circuitry in a control panel.

The manually operated pull-stations and automated sensor devices work in conjunction with one another to send a signal to an alarm control panel located within the emergency system, indicating that a specified emergency (fire, water, tornado, etc.) exists. In response, the emergency alarm system will alert the building occupants and the proper authorities, such as the police department, the fire brigade and the municipal fire department of the emergency condition, so appropriate action may be taken.

As stated previously, emergency alarm systems employ both manually operated devices and automatic devices to activate the emergency control panel. In most cases, automatic devices such as smoke detectors, heat detectors, and water flow sensors, are used to activate the control panel of the emergency alarm system. For example, smoke detectors are employed in fire alarm systems. The detectors are placed throughout the building and are connected to a wiring system that enables communication to exist between the smoke detectors and the control panel of the fire alarm system. Each individual smoke detector utilizes a sensing device that enables it to sense smoke. Depending upon the specific detector, it may use either a photoelectric sensor, an ionization sensor or both. A photoelectric sensor detects particulate matter in the environment due to fire. The particles are larger in size and usually originate from materials that are smoldering. On the other hand, an ionization sensor detects small particulate matter in the environment that usually results from extremely intense, hot fires. However, the sensors respond identically upon detection of particles in the air.

When detection occurs, the smoke detector's load on the fire alarm system wiring increases. This event in turn communicates to the to control panel of the fire alarm system that a fire emergency exists. In response to this communication, the fire alarm system alerts the occupants of the building by activating sound generators which generate an audible sound. In addition, the fire alarm system alerts the proper authorities such as the fire brigade, the municipal fire department and/or the police department so appropriate action may be taken.

Alternatively, fire alarm systems also employ manually operated fire alarm pull-stations. Their primary function is to allow the building occupants to send a signal to the alarm control panel to indicate a fire (or other) emergency exists. Like the automated devices, the manually operated devices are placed throughout the building and are connected to a wiring system that enables communication to exist between the pull stations and the control panel of the fire alarm system.

Upon actuation of the alarm pull-station, the pull-station's load on the system wiring changes, sending a signal to the alarm control panel indicating an emergency exists. In response to this communication, the alarm system alerts the occupants of the building by activating sound generators which generate an audible sound. In addition, the alarm system alerts the proper authorities such as the fire brigade, the municipal fire department and/or the police department, so appropriate action may be taken.

Typically, the individual who performs the actuation of the fire alarm pull-station is the only person who is aware of the emergency condition and because of the this fact, these types of manually operated devices lend themselves to abuse. Many times the validity of the emergency condition is dependent upon the integrity of the individual actuating the fire alarm pull-station. Sometimes false alarms occur when an individual actuates a fire alarm pull-station erroneously and/or unintentionally. However many times a false alarm is done intentionally. When this occurs, the individual usually vacates the scene immediately to avoid detection. As a result, the identity of the individual is unknown, and therefore appropriate disciplinary action can not be taken.

As a result of false alarms, unnecessary disorder and safety risks result. In addition, false alarms are expensive for all who are involved. Individuals are taught that during a fire emergency, they should remain calm and exit the premises in a quick and orderly fashion. However, building emergency evacuations are still inconvenient. In addition, the buildings are sometimes very large, possibly several stories in height, and due to the potential disorderliness of the evacuation and the size of the premises, the potential for inconvenience is high.

False alarms may also be very costly. As described previously, when a fire alarm is activated, the entire building is generally evacuated, and the occupants generally may not re-enter until the proper authorities deem the premises safe. This in turn can cause businesses located in the particular building to lose valuable time and money. Furthermore, every time a fire department, paramedic unit, or police department dispatches its units to an emergency or potential emergency, it costs that particular municipality money. This cost to the municipality is then often passed on to the members of the community in the form of higher taxes.

There is therefore a need for an emergency alarm system, which employs a manually operated pull-station, with a security feature that deters individuals from erroneously and/or intentionally actuating the alarm pull-station. More particularly, there is a need for a deterrent mechanism for manually operated emergency alarm pull-stations that not only deters individuals, but allows authorities to identify the individual who did in fact actuate the pull-station.

SUMMARY OF THE INVENTION

The foregoing needs are met, to a great extent, by the present invention where, in one aspect, an emergency alarm system is provided having a manually operated pull-station that activates the system. The emergency alarm system has a camera that provides image data of the area surrounding the pull-station. The emergency alarm system also has a control panel having a image memory that provides for storage of the image data from the camera.

In accordance with another aspect of the present invention, the emergency alarm system includes a means for manually activating the emergency alarm system. The emergency system also has the capability for obtaining image data in the vicinity of the activating means. In addition, the device provides a means for storing the obtained image data.

There has thus been outlined, rather broadly, the more important features of the invention in order that the detailed description thereof that follows may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The present invention includes, for example, two aspects. In the first aspect, a "stand alone" pull station is provided that includes a built in camera and a local image storage device provided in the pull station. When the pull station is activated, a still or moving video image is recorded and stored locally at the local storage device. The camera can be continuously operating and storing the image information, or can be activated so that it only captures video information and/or only stores the video information upon the occurrence of an activation, and/or for a predetermined time thereafter. The local storage device can be a removable storage device that can be removed and transferred to another reading device or playback, or the storage device can be a permanently or semi-permanently mounted memory device within the pull station. In the latter case, a data port of some type is provided on the pull station so that the stored video information can be transferred to another device for recording and/or playback.

A benefit of including local storage of image data in the pull station is that the camera and storage features of the pull station are self-contained, and so the remainder of the alarm system does not need to be modified or differ from conventional alarm systems. That is, in these embodiments, the new feature of the camera is provided in the pull-station itself.

If there are features of the camera that can be adjusted or set, this adjustment or setting can occur through a data port if one is provided.

In the second aspect of the invention, the camera is also provided within the pull station. However, the pull station communicates the image data from the camera through the alarm system to be viewed and/or stored at a remote location. The pull-station may transmit images from its camera via wires, wirelessly, or through other means. In this system, images may be stored locally, but regardless of whether they are stored locally, they can also be viewed and/or stored at the remote location. Moreover, a operator at a remote location can monitor the images there continuously, at regular intervals, or only when the pull station is activated.

If the pull station has a data port, then adjustments or control settings can be made through the data port, and/or the adjustments can be made through the communication link provided between the pull station and the alarm system itself. Images from the camera can not only provide video image of someone who activates the pull station, but also can serve as a security monitoring camera of the area which it is viewing.

Figure 1:
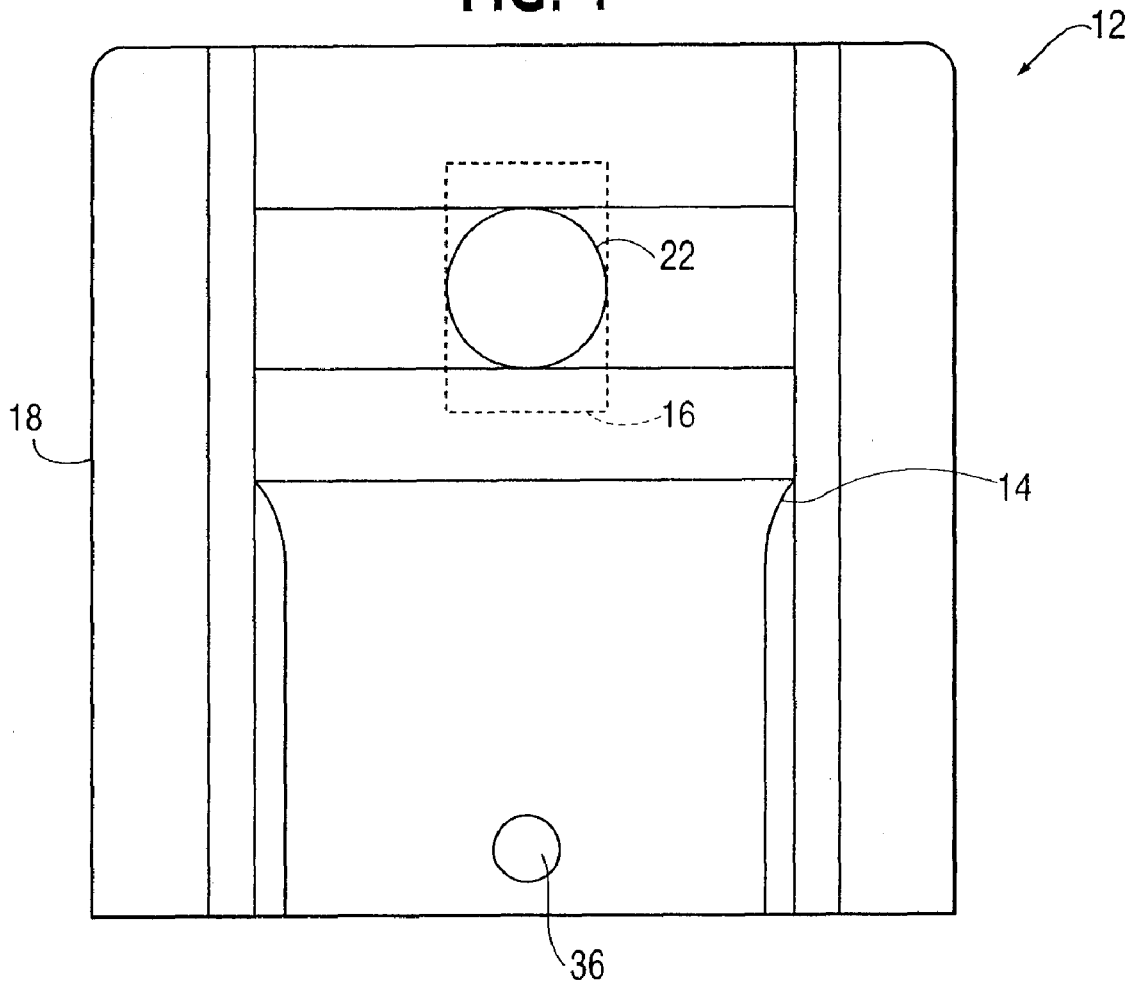
FIG. 1 is a front view depicting a manually operated emergency alarm pull-station with a camera incorporated therein, in accordance with a preferred embodiment of the invention.
Figure 2:
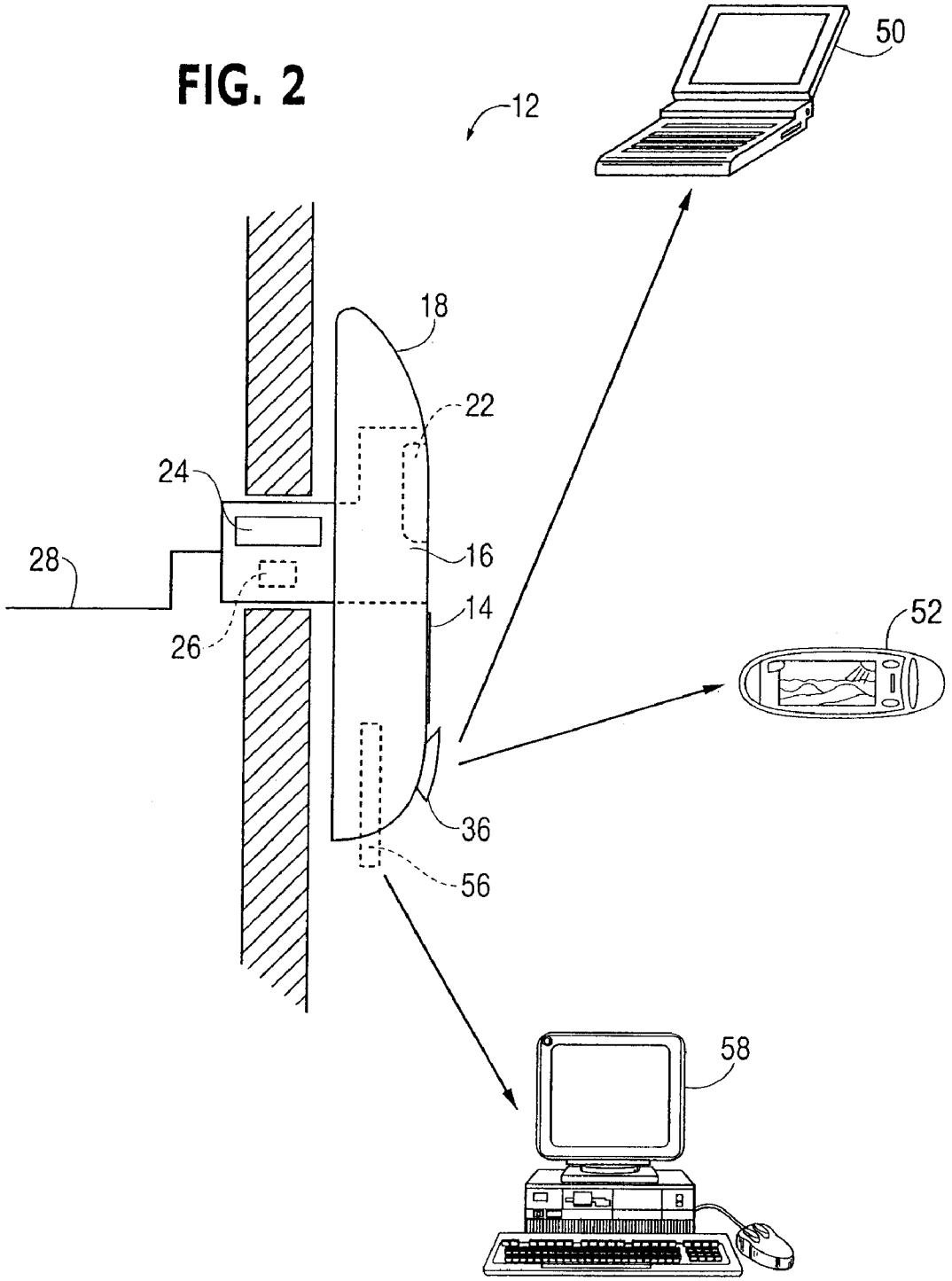
FIG. 2 is a schematic view depicting a manually operated emergency fire alarm pull-station in accordance with other preferred embodiments of the present invention and various data input and output devices which may be utilized in preferred embodiments of the invention.
Figure 3:
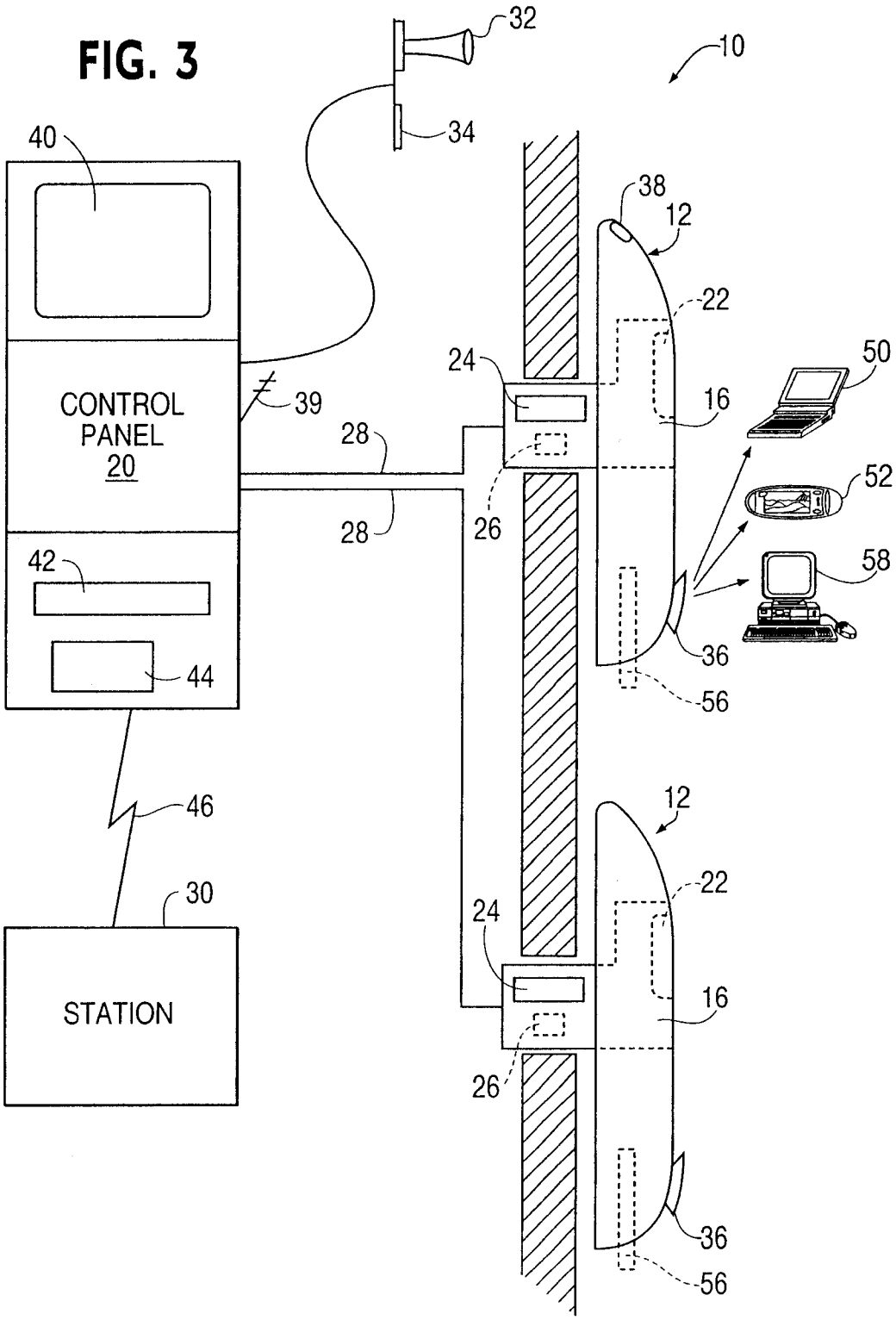
FIG. 3 is a schematic view depicting an emergency fire alarm system in accordance with preferred embodiments of the invention.
Figure 4:
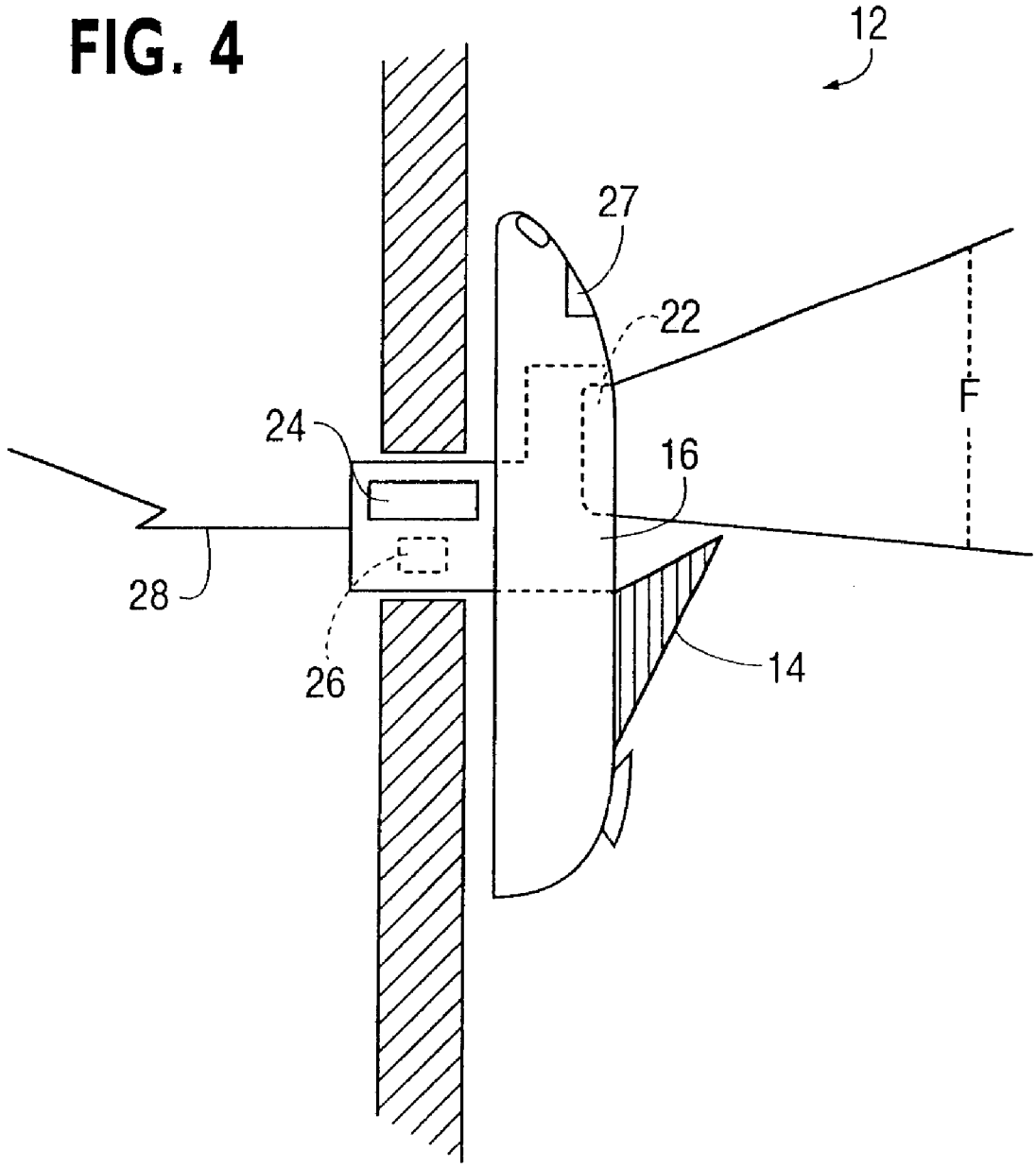
FIG. 4 is a side view of the fire alarm pull-station according to embodiments of the present invention in an activated position.

FIGS. 1 and 4 illustrate a pull station having a camera such as can be used in both the self-contained and system types of embodiments. FIG. 2 depicts an arrangement that is particularly suitable for the self-contained embodiments. FIG. 3 depicts an arrangement that is particularly suitable for the system embodiments.

The camera 16 used in the present invention may be any suitable form of image capturing device. For example, it may be a CCD type camera or other appropriate still or video camera. In the preferred embodiment, the camera is of a type that converts the image into electronically storable image data. Such a camera may be a so-called video camera, although it may record one or more still images and/or may record live, or continuous, video.

Referring now again to the figures wherein like reference numerals indicate like elements, FIGS. 1–4 illustrate a presently preferred embodiment of a fire alarm system 10 having a manually operated fire alarm pull-station 12 with a video camera mechanism 16. While in the embodiment depicted the emergency system is a fire alarm system, it should be understood that the present invention is not limited in its application to fire alarm systems, and can be used with other emergency signals systems.

An example of a method of operation that may be particularly suitable for the self-contained type of embodiment such as shown in FIG. 2 is as follows. The camera 16 remains in a passive state to save energy until the pull station is activated by someone pulling the lever 14. Immediately upon the activation of the lever 14, the camera is switched on and begins taking a picture of the person who has pulled the lever.

The camera can take power off the power signal line. Alternatively it can have an interval battery for power. In some embodiments, the camera takes a single still picture when the pull station is activated and saves it on an image storage device 26. When only a single still picture is taken, the requirements for the image storage device 26 site is reduced compared to taking moving video or several pictures. However, the invention may also take several pictures in series or may take a video of a specified length. Auto focus technology and/or a motion sensor can be employed so that the series of still pictures, or the video, continues during the time while motion is detected in front of the camera.

After the pictures have been taken, they are stored until a user approaches the station 12 and retrieves the image data. The image data may be retrieved by removing the memory unit 56 or by accessing the data port 36 via e.g., a laptop computer 50, a PDA 52, or a desktop computer 58. The images from the removable memory device 56 and/or the images accessed through the data port 36 may then be analyzed at any appropriate site. If the pull station has sufficient memory capability, it is possible for the camera to remain on constantly, regardless of whether the pull station has been activated. The memory can restart periodically. Other information such as the date and time of activation of the pull station is also recorded, and events occurring both prior to and subsequent to the activation of the pull station can be recorded.

A preferred embodiment of the pull station of the present inventive apparatus and method is illustrated in FIG. 2, which illustrates a manual fire alarm pull-station 12 having a lever 14, a camera 16 and a frame assembly 18. In order to activate the alarm system 10, the lever 14 is moved from an armed position, as shown in FIG. 2, to an activated position, as shown in FIG. 4. In its activated position, the lever 14 and the assembly 18 of the pull-station 12 interact to close a switch mechanism that completes a circuit monitored by the control panel 20 (shown in FIG. 3) of the alarm system 10. The control panel 20 then performs various functions such as imitating an audible and/or visual alarm as discussed in greater detail below. The lever 14 also triggers the camera 16.

The camera 16 is preferably a live, video camera having a lens 22, operating circuitry 24 and in some embodiments an image storing device 26. As shown in FIG. 2, the camera 16 is mounted in the assembly 18 so that the lens 22 is a distance from the lever 14 such that when the pull-station 12 is actuated, the field of view of the lens 22 is not obstructed. In addition, the lens 22 produces a field of view that is three feet wide and a distance of three feet from the lens. This field of view is selected so that at arm's length the operator's face is visible, so that the individual actuating the pull-station may be identified.

In an alternative embodiment, a modified lens may be employed, producing a 180° field of view. This view prevents an individual from approaching the pull-station 12 and hiding closely adjacent to the planar surface on which the pull-station is mounted (attempting to avoid the view of the camera), actuating the pull-station, and escaping undetected.

The camera 16 may have control circuitry to change between various fields of view selectively or at fixed time materials. The camera lens 22 may also be adjusted and/or modified so that the parameters of the field of view and image clarity may be modified to fit varying applications. The camera may have fixed focus, selectable focus, and/or use auto focus technology.

FIG. 3 depicts an entire emergency system 10 utilizing the manually operated pull-stations 12 of the present invention. FIG. 3 depicts a pull-station 12 that includes image storage in the pull station 12. Since the arrangement of FIG. 3 can use existing wires 28, it enables existing emergency systems to be retrofitted by replacing manually operated pull-stations with pull-stations having video image capability. Therefore, emergency systems may employ the video technology of the present invention at a low cost when compared to implementing an entirely new fire alarm system. FIG. 3 also illustrates a number of manually operated pull-stations 12 of the present invention with a removable image memory element 56 that is connected to the pull-station 12 via a bay. The memory element 56 may be removed by the user and taken to a desktop computer 58, for example, to display the imagery data contain therein.

Turning now to the system shown in FIG. 3, a wide variety of methods can be used to input data to the system and to retrieve data that has been stored by the multiple units of the alarm system 10. Any or all of these functions can be achieved by using any or all of the various peripheral communication equipment pictured and herein described. For example, as illustrated in FIG. 3, it is possible for an individual to visit the pull-station 12 and utilize a laptop computer 50 and/or a Personal Digital Assistant ("PDA") 52 to perform these functions on the pull-station 12. In addition, an individual may use a PDA 52 and/or a laptop computer 50 to input instructions to the camera 12, e.g., defining the field of view of the lens. Alternatively, the PDA 52 and/or a laptop computer 50 may be used to retrieve and/or display various information from the camera image storage 26, such as image data. These devices can be linked into the pull-station 12 either through a direct wire connection or through the preferred use of a wireless connection wherein the port 36, is an infrared input/output port.

Although the pull-station 12 has been described as having a live video camera, this is merely one preferred embodiment of the present invention. The pull-station 12 of the fire alarm system 10 may employ various types of cameras including e.g., live video, still video, and cameras equipped with night vision capability. The choice of camera can be predicated upon the particular conditions that will be encountered in the situation for which the apparatus is designed.

A flash light element 27, shown in FIG. 4, may also be used. The flash element 27 may be e.g., a strobe light that illuminates when the pull station is activated.

Another preferred embodiment of the present inventive apparatus and method is illustrated in FIG. 3, which illustrates a fire alarm system 10 for a building or other area, having a plurality of pull-stations 12 distributed throughout the building, wiring 28 that carries power to the pull-stations 12 and connects the pull-stations 12 to the control panel 20 and/or to an on-site or off-site monitoring station 30, sound generators 32, and visual signals 34. Each pull-station 12 has a camera 16, connecting wires 28, an antenna 38 and/or an input/output port 36. The camera has a lens 22, circuitry 24, an image storing device 26 and is powered and connected to the control panel 20 via the connecting wires 28.

In one embodiment, the pull-station 12 and camera 16 communicate with the control panel 20, indicating activation of the pull-station and/or transmitting images via the wires 28. Alternatively, the pull-station 12 may communicate with the control panel 20 using the antennas of both devices, 38 and 39 respectively. Thus, the pull-station 12 may communicate by either corded and/or wireless fashion with the control panel 20.

The control panel 20 incorporates a plurality of devices and units used to process and comprehend the data being communicated from the pull-station 12. In some embodiments the control panel 20 may communicate with an off site monitoring station 30. FIG. 3 illustrates the control panel 20 having a video display monitor 40, video cassette recorder 42, digital image storage device (e.g. a hard drive or writable CD-Rom) 44 and an up-link 46, to an on or off-site monitoring station 30. The aforementioned linkage between the control panel 20 and the off-site station 30, may be by direct wiring or cordless communication.

The video display monitor 40 enables an individual to observe the images that are being communicated to the control panel 20 from the camera 16 at the control panel location. In addition, the video cassette recorder 42 and digital storage device 44, allow for the recording and storing of video images produced by the camera 16, which can be viewed later on the monitor 40 and/or at the station 30.

The control panel 20 additionally may also have an up-link device 46, enabling the control panel to communicate the images and data received to an on or off-site location including fire departments, police departments, security company and/or "guard shack" or kiosk located on the premises. The aforementioned communication may be via direct wiring or cordless, and such communication mediums may include the Internet, radio frequency (RF), infrared frequency and satellite communication.

The control panel 20 receives data regarding the status of the pull-station 12, which may include actuation of the pull-station, location of an actuated pull-station time and date of actuation, and video and other picture data from the camera 16. The video data may include moving, still, live and/or recorded data. The control panel 20 proceeds to process the data, wherein it may determine to activate the audible generators 32 and visual signals 34. In addition, the image data may be displayed and/or recorded on the video display monitor 40 and the recording devices 42 and 44. Depending upon the programming and set-up of the of the control panel, which is specific to each end user and application, while performing the above described steps, the panel may simultaneously communicate such information to a third location.

FIG. 3 illustrates a schematic view depicting the pull-stations 12 of the present invention, and various data input and output devices which may be utilized in the preferred embodiments of the present invention. As shown in FIG. 3, a wide variety of methods can be used to input data to the system and to retrieve data that has been stored by the multiple units of the alarm system 10. Any or all of these functions can be achieved by using any or all of the various peripheral communication equipment pictured and herein described. For example, as illustrated in FIG. 3, it is possible for an individual to visit the pull-station 12 and utilize a laptop computer 50 and/or a Personal Digital Assistant ("PDA") 52 to perform these functions on the pull-station 12. In addition, an individual may use a PDA 52 and/or a laptop computer 50 to input instructions to the camera 12, e.g., defining the field of view of the lens. Alternatively, the PDA 52 and/or a laptop computer 50 may be used to retrieve and/or display various information from the camera image storage 26, such as image data. These devices can be linked into the pull-station 12 either through a direct wire connection or through the preferred use of a wireless connection wherein the port 36, is an infrared input/output port.

FIG. 4 depicts the pull-station 12 of the present invention during manual actuation. The lever 14 has been displaced from an armed position, as shown in FIG. 1, to an activated position of FIG. 4, activating the fire alarm system 10. FIG. 4 also illustrates the spatial relationship between the camera lens 22 and the lever 14. As is readily apparent, the lens 22 is a distance from the lever 14 such that when the pull-station 12 is actuated, the lever 14 does not obstruct the field of view F of the camera 16, enabling the individual who actuated the pull-station 12 to be readily identified.

It will be appreciated that various embodiments of the invention, including the self-contained and system embodiments, provide for the advantage of taking a picture of someone who activates a fire alarm pull station. This can be very beneficial in identifying person who undesirably cause false alarms. Further, in embodiments where the camera lens is visible, the mere existence of the camera lens can have the deterrent effect, thereby discouraging individuals from causing false alarms in the first place.

Another benefit of embodiments of the present invention is that pictures are taken of the premises that will sometimes generally correspond to the occurrence of emergencies. Furthermore, in cases other than false alarms that are actually emergencies, valuable camera data feed may be obtained that may help in identifying the cause of the emergency. In these ways, the invention provides a form of video security system, which is in addition to activation function of the pull station. Thus, embodiments of the invention can provide a convenient way of installing a video security system, utilizing the mounting locations that would already be occupied by a pull-station.

The above description and drawings are only illustrative of preferred embodiments which achieve the objects, features, and advantages of the present invention, and is not intended that the present invention be limited thereto. Any modification of the present invention which comes within the spirit and scope of the following claims is considered to be part of the present invention.

What is claimed is:

1. An emergency alarm system, comprising:

a manually operated pull station that activates the system;

a camera obtaining image data in the vicinity of said pull station;

a control panel having image data memory that stores image data from said camera; and a peripheral communication device, wherein the peripheral communication device communicates with at least one of said pull station and said control panel to transfer at least one of image data and commands.

2. The emergency system according to claim 1, wherein the peripheral communication device is a laptop computer.

3. The emergency system according to claim 1, wherein the peripheral communication device is a Personal Digital Assistant.

4. The emergency system according to claim 1, wherein the peripheral communication device is a desktop computer.

5. The emergency system according to claim 1, wherein said pull-station communicates with the peripheral device via an infrared signal.

6. The emergency system according to claim 1, wherein said pull-station communicates with the peripheral device via direct wire connection.

7. The emergency system according to claim 1, wherein the pull-station communicates with the peripheral device using wireless RF frequency.

* * * * *